United States Patent [19]

Ruger et al.

[11] Patent Number: 4,575,963

[45] Date of Patent: Mar. 18, 1986

[54] PISTOL MECHANISM FOR BLOCKING FIRING PIN

[75] Inventors: William B. Ruger, Croydon, N.H.; Roy L. Melcher, Stratford, Conn.

[73] Assignee: Sturm, Ruger & Company, Inc., Southport, Conn.

[21] Appl. No.: 624,185

[22] Filed: Jun. 25, 1984

[51] Int. Cl.[4] ..... F41C 17/04

[52] U.S. Cl. ..... 42/70 F

[58] Field of Search ..... 42/70 R, 70 F

[56] References Cited

U.S. PATENT DOCUMENTS

| | | | |
|---|---|---|---|
| 3,724,113 | 4/1973 | Ludwig | 42/70 F |
| 3,830,002 | 8/1974 | Volkmar | 42/70 F |
| 4,011,678 | 3/1977 | Brodbeck et al. | 42/70 F |
| 4,369,593 | 1/1983 | Zedrosser et al. | 42/70 F |
| 4,454,673 | 6/1984 | Meidel | 42/70 F |

FOREIGN PATENT DOCUMENTS

| | | | |
|---|---|---|---|
| 8203910 | 11/1982 | European Pat. Off. | 42/50 |
| 660046 | 10/1951 | United Kingdom | 42/70 F |

*Primary Examiner*—Charles T. Jordan
*Assistant Examiner*—Ted L. Parr
*Attorney, Agent, or Firm*—Pennie & Edmonds

[57] ABSTRACT

A frame-mounted firing pin blocking piece for blocking a semi-automatic pistol firing pin which blocking piece at all times blocks the firing pin except just prior to and at firing. The blocking piece is rotated to its unblocking position by action of a trigger bar which bar is in turn positioned by the trigger and the firearm slide. A sear associated with the firing pin blocking piece permits such operation in single action, double action and re-set modes.

6 Claims, 17 Drawing Figures

PISTOL MECHANISM FOR BLOCKING FIRING PIN

BACKGROUND OF THE INVENTION

A prior proposed firing pin blocking mechanism for semi-automatic pistols includes a pivotable element positioned below the firing pin which can be pivoted in one direction to block or in the opposite direction to unblock the firing pin. In that system, the pivotable firing pin blocking element is actuated by a convoluted spring associated with the hammer.

Firing pin blocking has also been proposed in semi-automatic pistols using spring loaded transverse stud pieces which are mounted in the side of the pistol and reciprocate in a path perpendicular to the axis of movement of the firing pin. (See Ludwig U.S. Pat. No. 3,724,113 issued in April 1973; Volkmar U.S. Pat. No. 3,830,002 issued August 1974; Brodbeck U.S. Pat. No. 4,011,678 issued March 1977; and U.K. Pat. No. 660,046 published Oct. 31, 1951). In these prior patents, the stud pieces are reciprocated in slotways under spring action and can readily stick or jam if foreign matter enters the slotway.

Blocking and unblocking of the firing pin in a semi-automatic pistol during pre-firing, firing and post-firing is not satisfactorily accomplished by these prior proposals.

SUMMARY OF THE INVENTION

Broadly, the present invention is a mechanism including a trigger, novel trigger bar pivotably connected to the trigger, a configured slide, a sear and a pivotable frame-mounted firing pin blocking piece for accomplishing the blocking and unblocking of the firing pin in single action, double action and semi-automatic modes during pre-firing (except for a fraction of a second prior to and during firing) and for blocking the firing pin during post-firing operation and all non-firing conditions including carrying and handling of the pistol.

The novel trigger bar has a configured upper surface for engagement with the configured reciprocating slide and spring means to urge the trigger bar up against the slide thus causing the trigger bar to be positioned both by trigger movement and by slide reciprocation. The novel trigger bar also has an opening in its rearward portion which trigger bar opening receives a projecting lug portion of the firing pin blocking piece which lug is substantially smaller than the trigger bar opening thus resulting in engagement of the trigger bar with the blocking piece lug to unblock the firing pin just before firing and during firing and at no other times regardless of the position of (a) the trigger, (b) its attached trigger bar or (c) the reciprocating slide.

It is a feature of the invention that the rotatable firing pin blocking piece has a sear associated with it which is urged by a spring to its hammer engaging position and is rotated in the opposite direction to release the hammer and fire the pistol. The sear is rotated by the firing pin blocking piece which initially rotates to unblock the firing pin and then continues to rotate as it engages with the sear and causes the sear to rotate by rotation of the firing pin blocking piece against it.

It is also a feature that the hammer and trigger bar are shaped and positioned so that during full manual hammer cock the trigger bar does not cause unblocking of the firing pin.

DESCRIPTION OF THE PREFERRED EMBODIMENT

Figure 1:
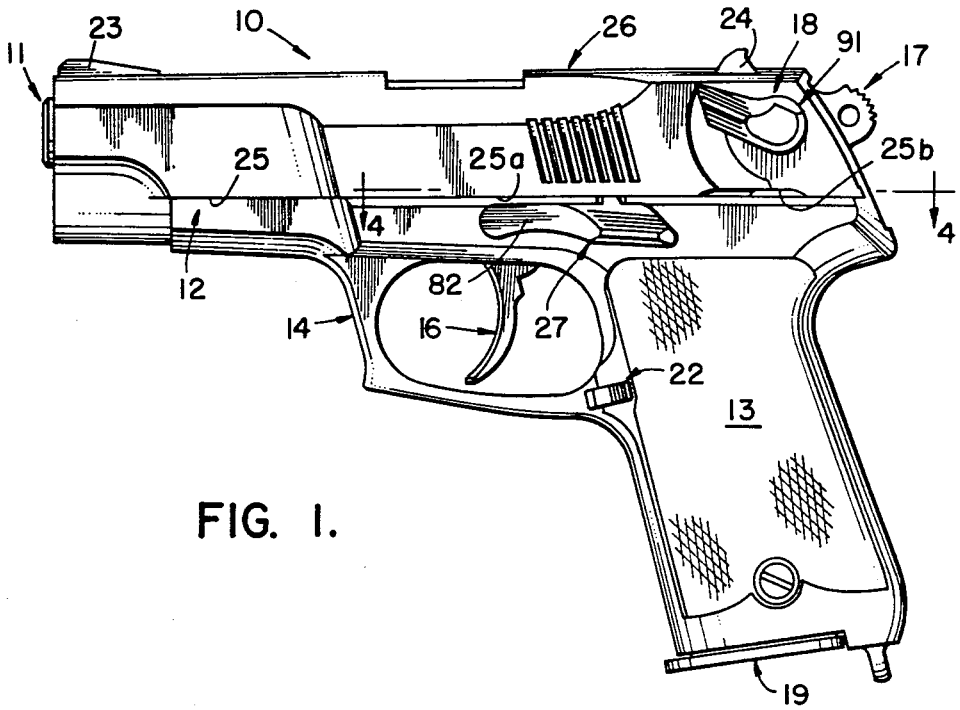
FIG. 1 is a side elevational view of a semi-automatic pistol embodying the invention.

In FIG. 1, semi-automatic pistol 10 includes barrel 11, frame 12, grip 13, trigger guard 14, trigger 16, hammer 17, manual safety lever 18, magazine 19, magazine release lever 22 and front and rear sights 23 and 24, respectively. Also shown is slide 26 and slide lock lever 27.

Figure 2:
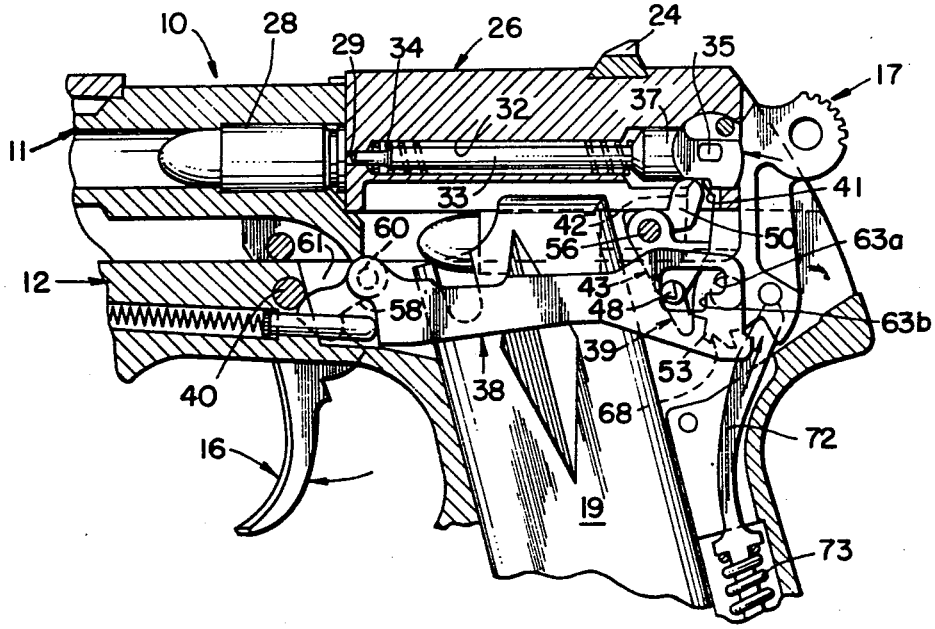
FIG. 2 is a partial sectional view through the centerline of the barrel and perpendicular to the trigger and hammer pivots.
Figure 3:
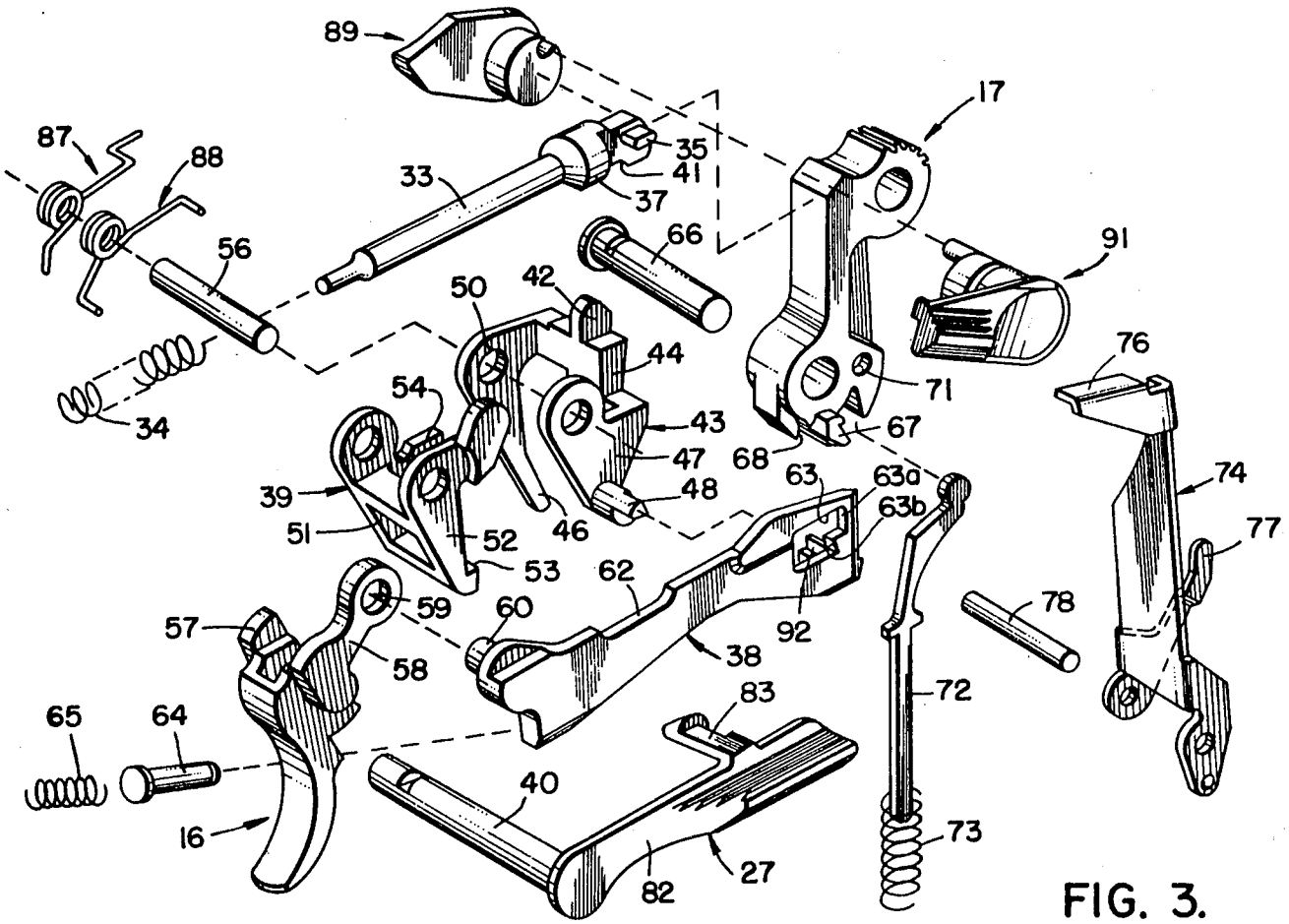
FIG. 3 is an exploded view of the rotatable firing pin block piece and the related parts of the mechanism for controlling the block piece.

Turning to FIGS. 2 and 3, barrel 11 carries a cartridge 28 including primer 29, a slide 26 with a firing pin housing cavity 32 and a firing pin 33 positioned therein. Firing pin 33 is normally urged to the rear by firing pin spring 34 which rearward movement of the firing pin 33 is limited by a firing pin side projection 35 of firing pin head portion 37. Firing pin head portion 37 has formed thereon an angled stop surface 41 which engages projection finger 42 of pivotable firing pin blocking piece 43 to block firing pin 33. Also shown are trigger bar 38 and pivotable sear 39.

Firing pin blocking piece 43 includes center body 44 carrying upstanding blocking finger 42; depending ejector engageable leg 46 and spaced-apart depending support piece 47 which carries blocking piece stud 48.

Nested within the opening between the ejector leg 46 and support piece 47 of blocking piece 43 is pivotable sear 39. Sear 39 includes spaced-apart members 51, 52, sear notch 53 and sear manual latch projection 50. Member 51 has an upper surface 54 which engages with body portion 44 of blocking piece 43 when the blocking piece 43 is rotated about its pivot pin 56. Sear 39 also rotates about the same pin 56 as blocking piece 43.

Trigger 16 includes two (2) trigger pivot cams 57, 58. One cam 57 is on one side of trigger 16 and the other pivot cam with extension arm 58 is on the other side. Cam 58 includes opening 59 which carries trigger bar pivot stud 60 attached to (or forming a part of) trigger bar 38. Trigger 16 with its attached cams 57, 58 rotates in configured frame opening 61 and is restrained in part by latch axle 40 of latch 27.

Trigger bar 38 has upper configured cam surface 62 which rides against a lower interior surface 25 of slide 26 (FIG. 2). Interior slide surface 25 includes a straight portion 25*a* and a recessed portion 25*b*. Trigger bar 38 also includes trigger bar opening 63 which opening 63 includes a larger upper portion 63*a* and a smaller lower portion 63*b*. Trigger bar 38 is urged counterclockwise (FIG. 2) about pivot stud 60 by trigger bar plunger 64 urged by plunger spring 65. The travel and position of the trigger bar 38 during operation and handling of the pistol is determined by the position of trigger 16 and the position of reciprocal slide 26. The varying positions of these parts during pistol operation will be further described with reference to subsequent figures.

Hammer 17 is pivotable about hammer pivot 66. Hammer 17 includes side projection notch 67, sear notch 68 and hammer strut opening 71. Hammer strut 72 together with hammer strut spring 73 urge hammer 17 to its down position as shown in FIG. 2.

Cartridge ejector 74 includes cartridge engaging lip 76 and blocking piece engageable wing 77. Ejector 74 is pivotable about ejector pivot pin 78.

Also shown in FIG. 3 is slide lock lever 27 which includes slide lock axle 40, slide body portion 82; and catch 83. In addition sear return spring 87; blocking piece return spring 88; and manual safety sections 89 and 91 are shown. Trigger bar side extension 92 for engaging hammer projection 67 in double action operation is also shown.

Figure 4:
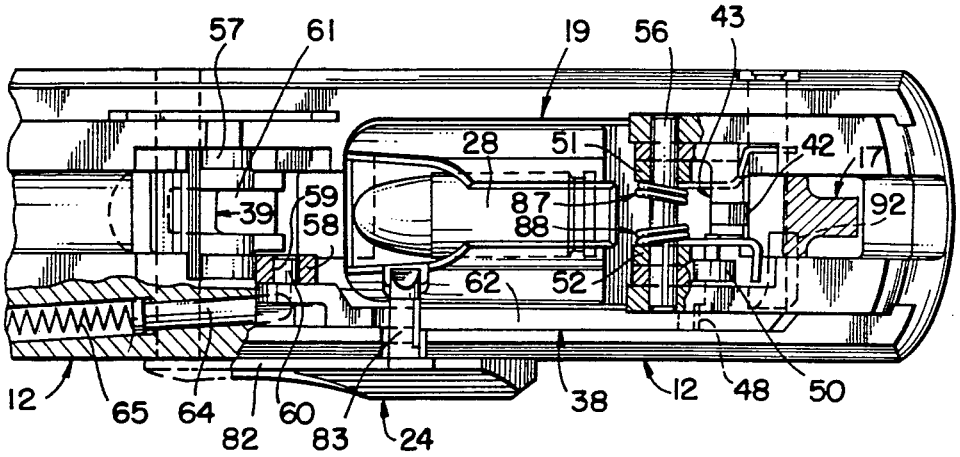
FIG. 4 is a plan view with the slide removed.
Figure 5:
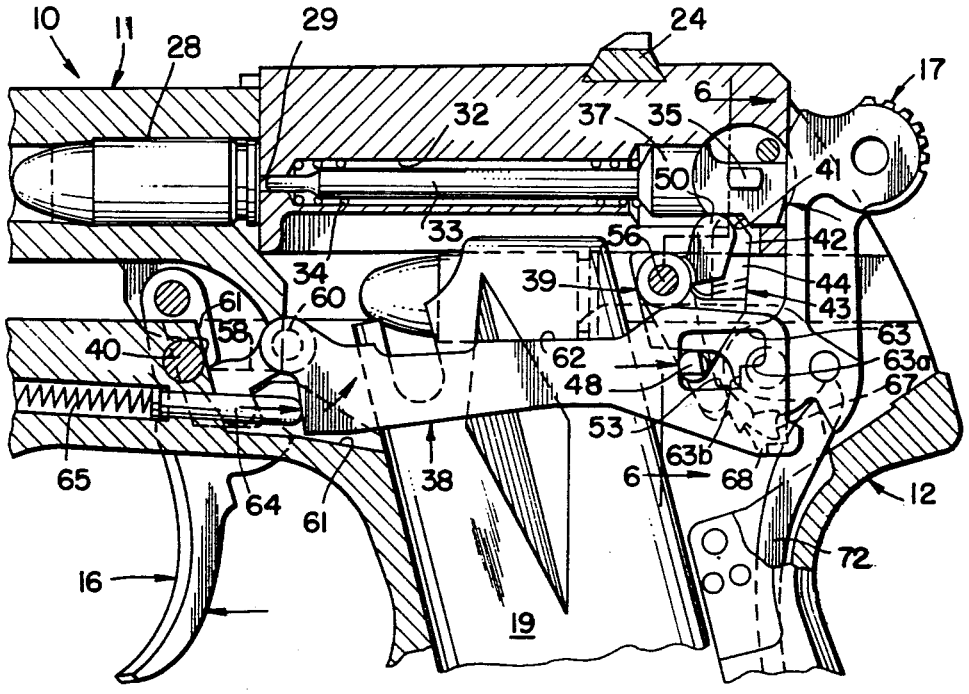
FIG. 5 is a partial enlarged view of FIG. 2 with the hammer down.

Turning now to FIGS. 4 and 5, the hammer 17 is shown down in its rest position with both firing pin blocking piece 43 and sear 39 rotated fully counterclockwise under urging of their return springs 87 and 88 and limited by lower interior surface of slide 26 (see FIG. 3). In this state, firing pin blocking piece 43 is in its blocking position with firing pin 33 constrained from being driven forward any substantial distance as its surface 41 will engage blocking piece projection finger 42 to block pin 33 from striking the primer 29 of cartridge 28.

Figure 6:
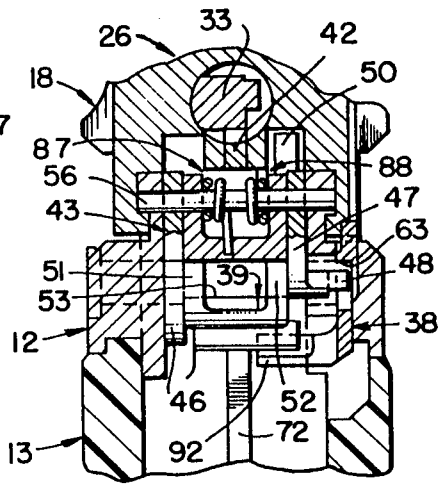
FIG. 6 is a section along line 6—6 of FIG. 5.
Figure 7:
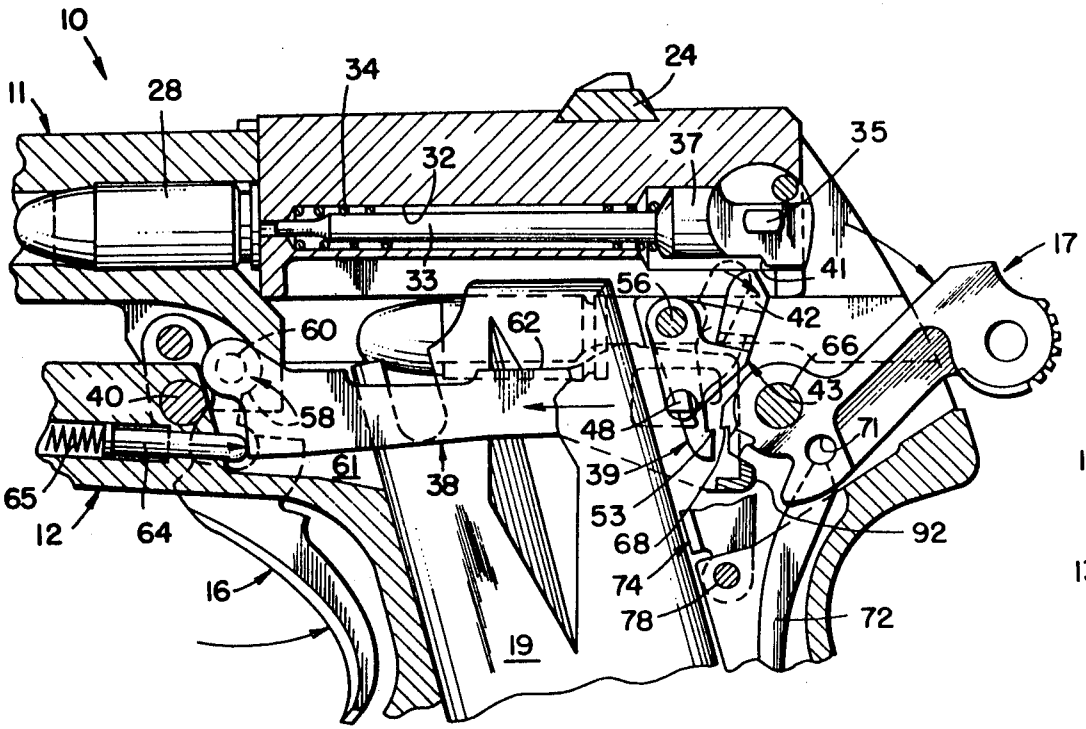
FIG. 7 is a partial enlarged view of FIG. 2 with the hammer fully rotated back by trigger pull.
Figure 8:
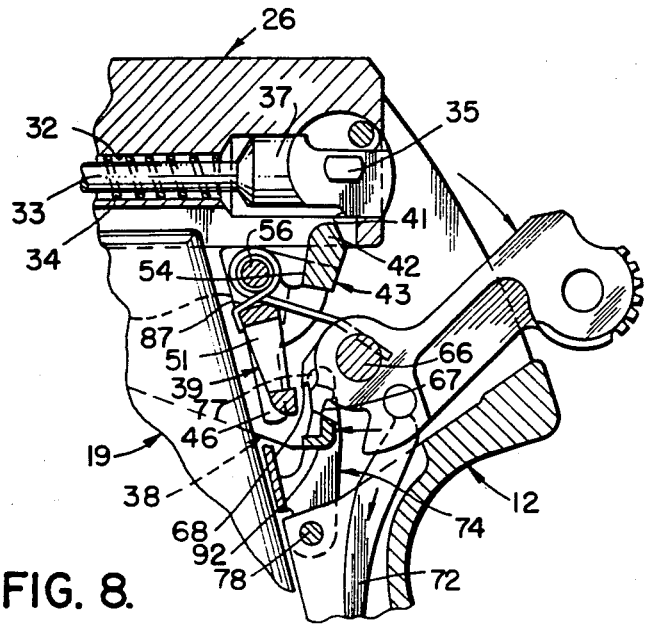
FIG. 8 is a partial enlarged view of FIG. 7.
Figure 9:
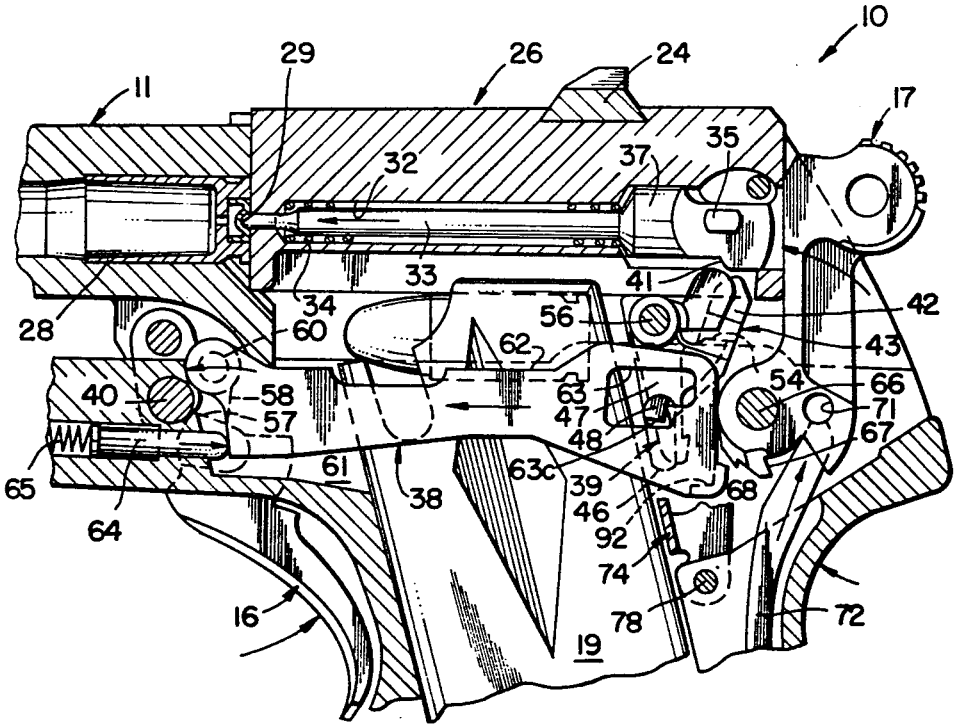
FIG. 9 is a side elevational sectional view showing the hammer down and trigger back.

Turning now to FIGS. 5–13, the following positions of the firing mechanism are shown:

(a) in FIGS. 5 and 6, the hammer 17 is down in its rest position with firing pin blocking piece 43 preventing firing pin 33 from engaging cartridge 38 should the pistol hammer 17 or other object strike the head 37 of the firing pin;

(b) in FIGS. 5, 7, 8 and 9, starting with the hammer down and operating in the double action mode, trigger 16 is pulled causing trigger bar 38 (and in particular its lateral extension 92) to move forward pulling hammer projection 67 to rotate hammer 17 back. As trigger pull continues, trigger bar 38 and its opening 63 move forward blocking piece stud 48 remains unengaged until surface 63*c* (the rearward surface of lower smaller opening area 63*b* of opening 63) is brought into contact with the blocking piece stud 48 (FIG. 7). Once the stud 48 is contacted by trigger bar 38 all further forward movement of trigger bar 38 causes rotation of the firing pin blocking piece 43 in a clockwise direction. As firing pin blocking piece 43 further rotates its upstanding finger 42 swings down below firing pin surface 41 to completely unblock firing pin 33. Finally, in the last stages of the forward movement of trigger bar 38 in this double action mode the bar 38 will release projection 67 of hammer 17 (FIGS. 7 and 8) to drop hammer 17 to fire (FIG. 9). In this just fired state, trigger bar 38 is in its up position nested in slide recess 25*b;*

Figure 10:
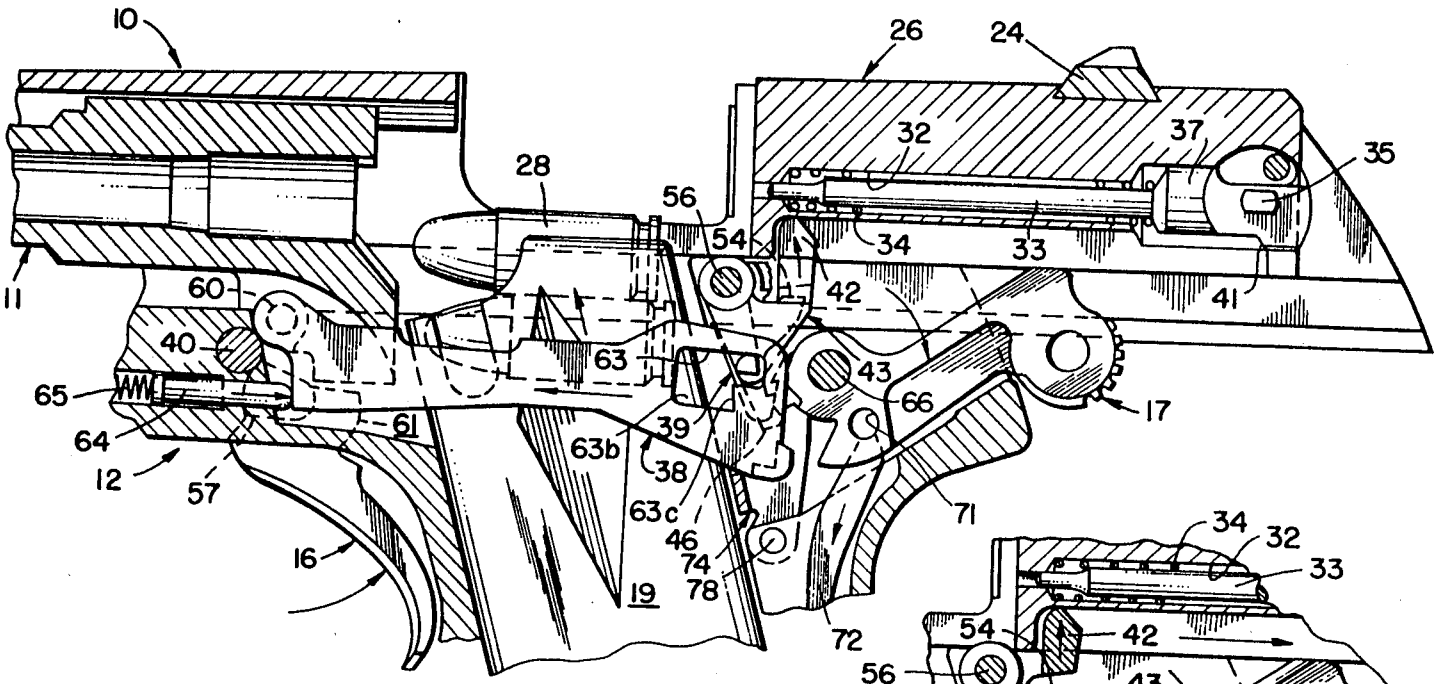
FIG. 10 is a side elevational sectional view showing the slide back with hammer cocked and trigger bar down.
Figure 11:
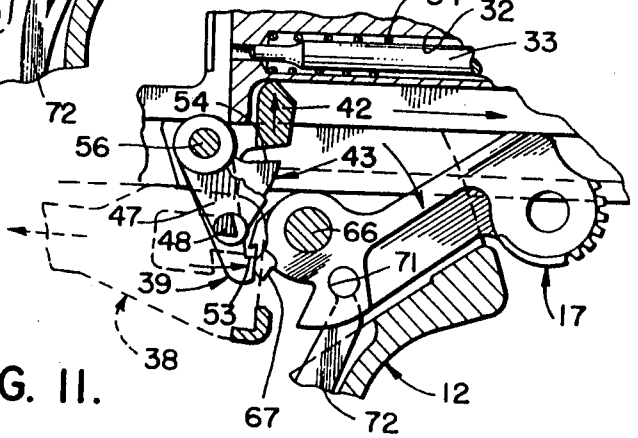
FIG. 11 is a partial enlarged view of FIG. 10.
Figure 12:
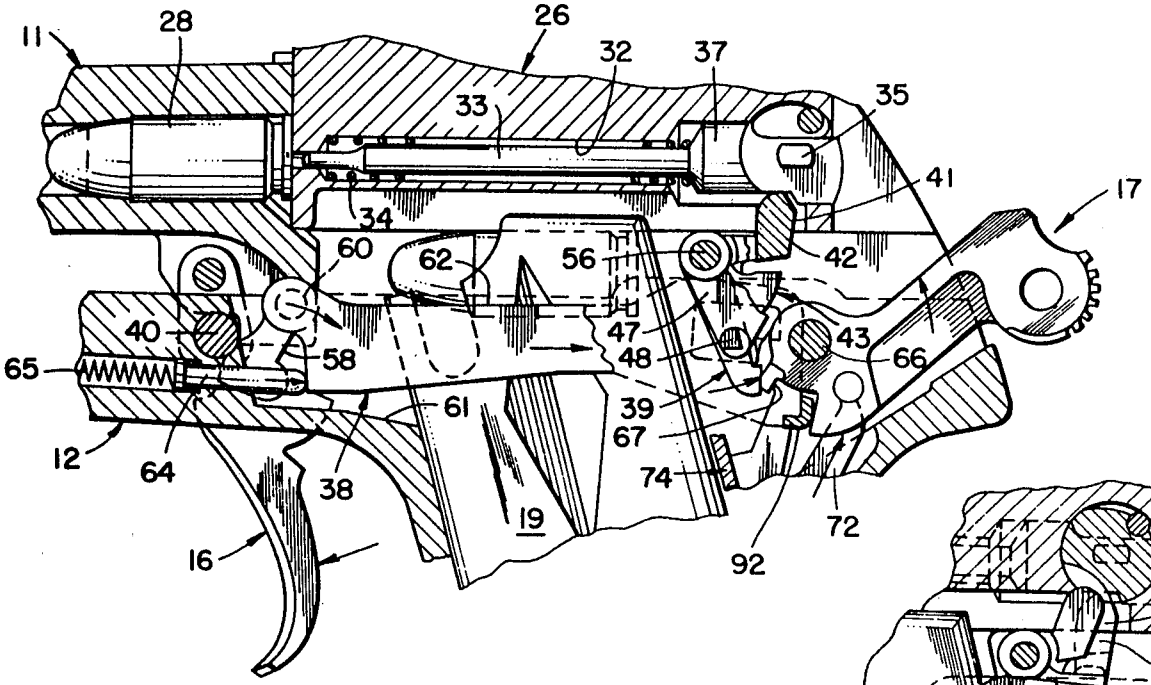
FIG. 12 is a side elevational sectional view of the hammer in cocked position held by the sear after an initial firing and slide return.
Figure 13:
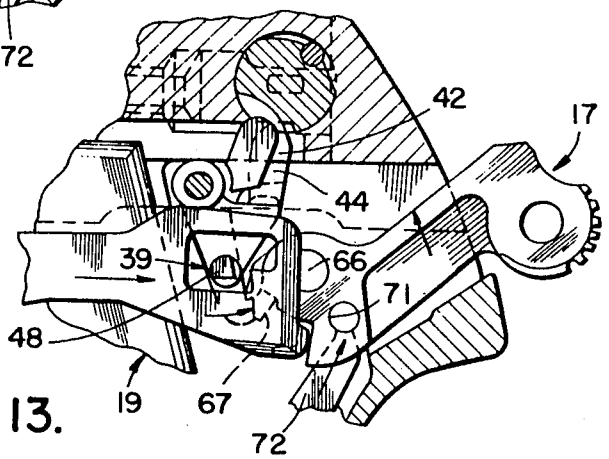
FIG. 13 is a partial enlarged portion of FIG. 12.
Figure 14:
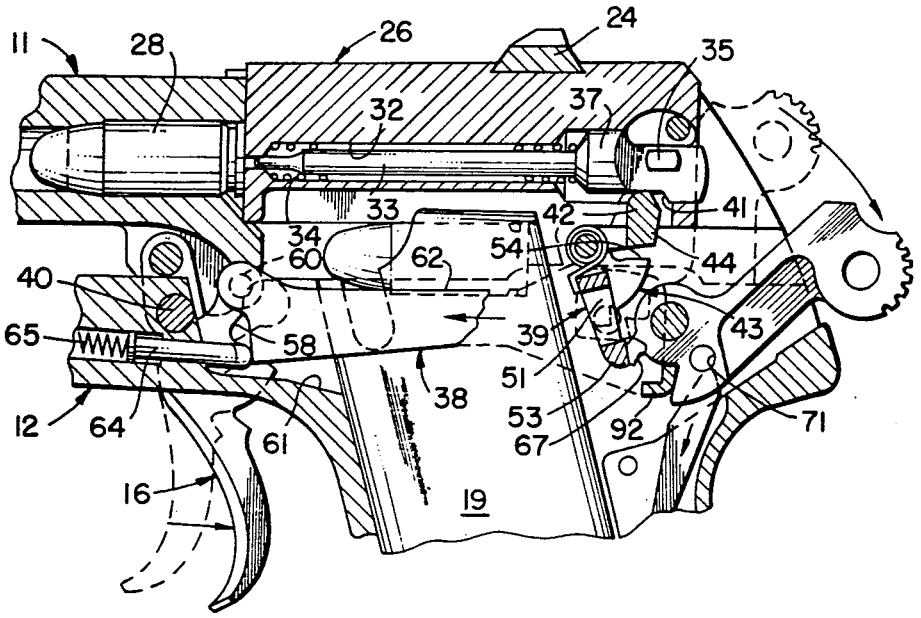
FIG. 14 is a side elevational sectional view in which the hammer or sear is in single action mode.
Figure 15:
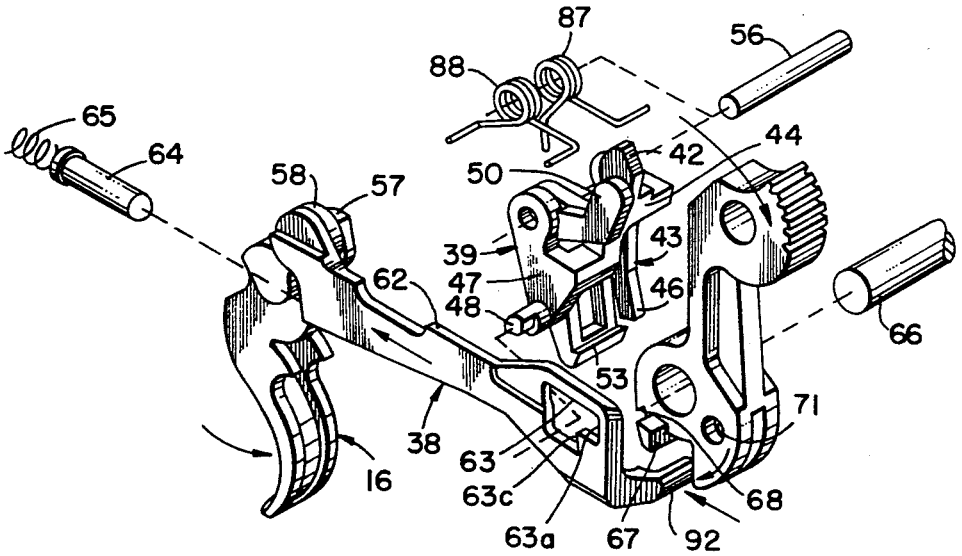
FIG. 15 is an exploded perspective view including the trigger, trigger bar, sear, firing pin blocking piece and hammer.

(c) immediately after firing the pistol slide 26 automatically moves to the rear to cock hammer 17 back and to lower trigger bar 38 as slide interior surfaces 25*a* and 25*b* ride on upper trigger bar surface 62 (FIGS. 10 and 11). With the trigger bar 38 now down, blocking piece stud 48 moves into the upper larger opening portion 63*a* of opening 63 as blocking piece 43 (and its stud 48) rotates to its blocking position (FIGS. 10 and 11). When slide 26 goes forward, hammer 17 rotates a portion of the way down until it engages and remains seated on sear notch 53 (FIG. 12). With slide 26 forward, trigger bar 38 has moved back up into slide surface recess 25*b*. Firing pin blocking piece follower 48 is now in the lower portion 63*b* of opening 63 of bar 38 and ready to be acted upon as when the bar again moves forward. This is the re-set position of the firing mechanism of the pistol;

(d) upon the next trigger pull, trigger arm 38 engages follower stud 48 of firing pin blocking piece 43 to rotate piece 43 which in turn rotates sear 39 by body portion 44 of the blocking piece 43 engaging sear surface 54 (see FIG. 3). Sear 39 continues to rotate with blocking piece 43, until sear notch 53 moves to the point that the hammer 17 is released and a subsequent firing occurs. The blocking piece 43 and sear 39 are preferably configured so that blocking piece 43 rotates a sufficient number of degrees to swing finger 42 just clear of the firing piece 33 before it (piece 43) first contacts the sear 39. Further trigger pull rotates blocking piece finger 42 to assure firing pin 33 clearance by the time sear 39 rotation releases hammer 27 to fire;

(e) in single action mode, hammer 17 is manually cocked back until hammer notch 68 of hammer 17 falls into sear notch 53 (FIG. 14). As described above, subsequent trigger pull causes trigger bar 38 to move, rotating blocking piece 43 (to unblock firing pin 33) and to then rotate sear 39 to release hammer 17 and fire the pistol; and (f) thus after the initial firing (from single or double action modes), the hammer 17 will automatically through reciprocal slide action be placed in a re-set mode (hammer 17 held by sear notch 53).

In the sequence of operations described above, the firing pin blocking piece 43 is in its blocking position at all times except just before firing and during firing. For example, immediately after firing with trigger 16 back, pistol slide 26 moves the trigger bar 38 down as it automatically moves back placing firing pin blocking piece stud 48 in the upper portion 63*a* of opening 63 (FIG. 10). In this trigger bar position, the firing pin blocking piece 43 moves to its normal blocking position. As the slide 26 in its normal cycle again goes forward, the trigger bar 38 will not rotate the blocking piece 43 to unblock the firing pin 33 even if the trigger 16 has been held back. With the trigger 16 held back, stud 48 will remain in opening 63*a* as the slide goes forward. Thus, when the trigger is held back during cycling of the slide, firing pin blocking piece 43 will remain in its blocking position. To fire the pistol from this trigger back position, the user must first move trigger 16 forward to allow the trigger bar 38 to move under detent spring pressure up against and into recess **25*b* of closed slide 26. The trigger bar 38 being now positioned with the blocking piece stud 48 in the lower portion 63*b* of the opening 63** is ready to be fired by a subsequent trigger pull.

Figures 16, 17:
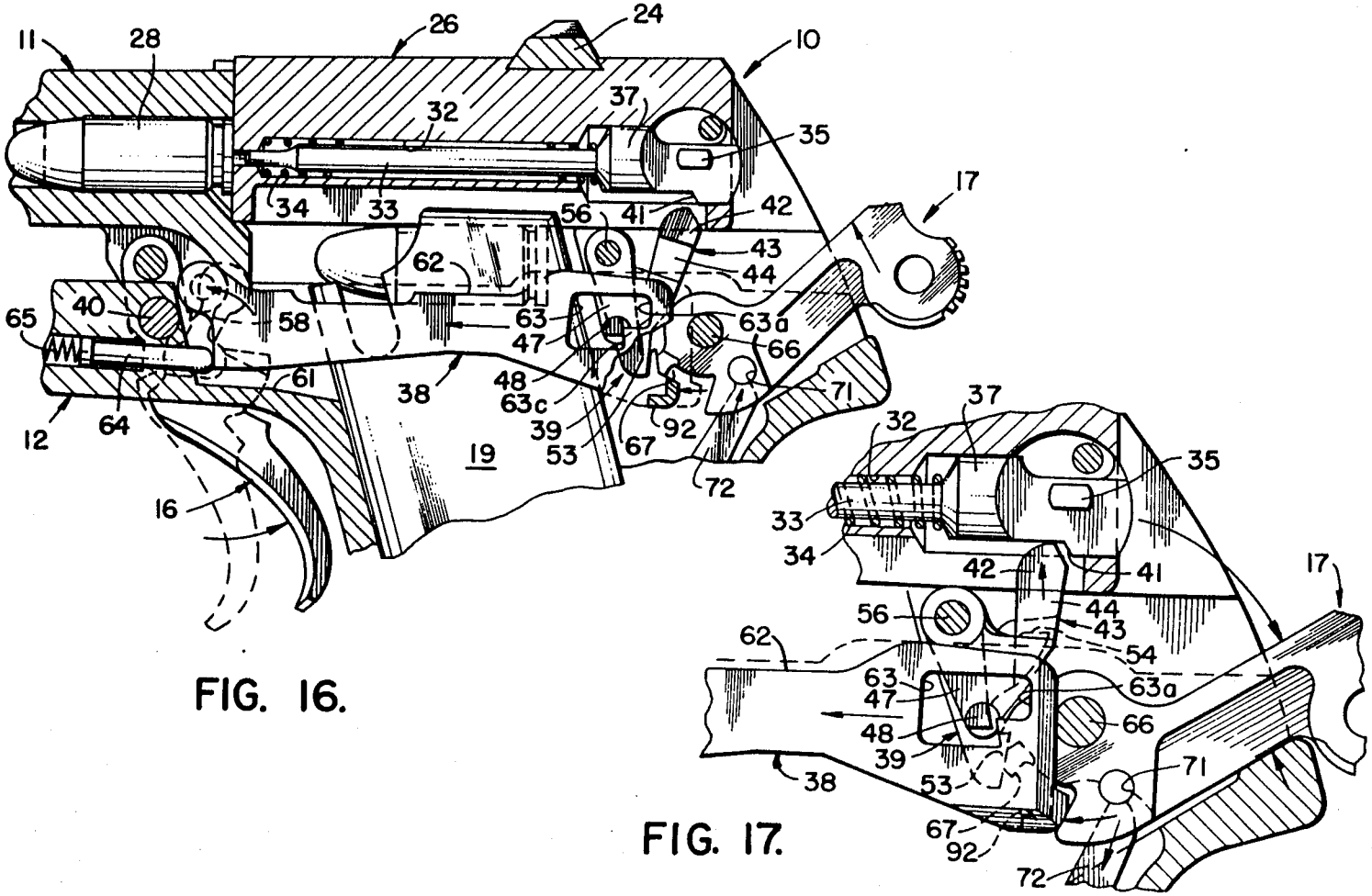
FIG. 16 is a side elevational sectional view showing the hammer being released and firing pin blocking piece rotating as the trigger bar moves forward.
FIG. 17 is an enlarged side elevational sectional view showing the hammer manually cocked against the frame with the firing pin blocking piece in its blocking position.

Turning finally to FIG. 17, hammer 17 is shown manually pulled back against frame stop surface 95. In this position, the firing pin blocking piece 43 remains in its blocking position with finger projection 42 in front of surface 41 of pin 33. The trigger bar 38, not being connected to hammer 17 and the hammer 17 and bar 38 being configured so as not to engage one another in this hammer position, trigger bar 38 remains stationary. Since only trigger bar movement can lead to the unblocking of firing pin, firing pin 33 remains blocked. If hammer 17 is released in this fully back position, hammer 17 will move forward under the force of strut 72 until the hammer notch 68 engages the sear notch 53.

Upon expenditure of all rounds in magazine 19, a new magazine is loaded and the initial firing can, as described above, be first by single or double action. Thereafter sequential semi-automatic firing may proceed from the reset position.

We claim:

1. In a semi-automatic pistol having a reciprocating slide with a firing pin therein, a trigger, a trigger bar, a sear, and a hammer, the improvement comprising (A) a pivotable firing pin blocking means mounted on the frame, the blocking means having
  (i) an upper finger means for blocking the firing pin;
  (ii) a lower trigger-bar-engageable projection lug positioned in and at times engageable with the trigger bar;

(B) a trigger bar having a forward end portion and a rearward end portion;
  (i) the forward end portion pivotable about the trigger;
  (ii) the rearward end portion having
    (a) a configured opening therein for receiving said blocking means projection lug;
    (b) a hammer engageable extension; and
    (c) a surface engageable with a surface on the slide;

(C) a sear mounted adjacent the blocking means and engageable with the hammer when the hammer is lowered; such sear caused to rotate by rotation of the blocking means;

(D) configured surface on the slide in engagement with the upper surface of the trigger bar to permit the rearward end portion of trigger bar to (i) raise when the slide is forward and (ii) to lower when the slide is rearward;

the trigger bar, trigger bar opening and blocking means projection lug being proportioned so that;

(a) when the hammer is in its at-rest position, the blocking means lug and trigger bar are not operably engaged permitting the firing pin to remain blocked;

(b) when initially pulled back, the trigger causes the hammer to rotate back through engagement of the trigger bar extension and hammer;

(c) when further pulled, the trigger moves the trigger bar and the bar opening forward engaging the blocking piece lug to rotate the blocking piece and unblock the pin;

(d) thereafter as further pulled, the trigger causes further forward movement of the trigger bar releasing the hammer which fires the pistol; and (e) when the trigger is held in its pulled position, the trigger bar and lug remain disengaged during the cycling of the reciprocating slide.

2. The improvement of claim 1 in which a predetermined amount of rotation of the blocking means from its blocking position causes such blocking means to engage a surface on the sear to rotate the sear to cause the hammer to be released from the sear.

3. The improvement of claim 1 in which the configured opening only engages the lug when the trigger bar is in its forward and upper positions.

4. The improvement of claim 1 in which the opening in the trigger bar includes (1) an upper larger portion configured to such size and shape that the lug fails to engage such opening during operation of the pistol and includes (2) a smaller lower portion with a rearward surface which engages and moves the lug during certain trigger bar forward positions.

5. In a semi-automatic pistol having a reciprocating slide with firing pin mounted therein, a trigger, a trigger bar, a firing pin blocking piece, a sear and a hammer, the improvement in which (a) the firing pin blocking piece is pivotably operable to block the firing pin in all operable positions of the trigger bar except the just-prior-to-firing position and the firing position; the firing pin blocking means in turn comprising
  (i) a housing including two spaced apart flange elements and a central body section between the two flange elements;
  (ii) a firing pin blocking projection upstanding from the central body section;
  (iii) a lug projection extending from a flange element engageable at times with the trigger bar;

(b) an opening in the trigger bar to receive the blocking piece lug which opening is configured such that as the trigger bar moves through its cycle the blocking piece lug is activated to rotate the blocking piece only just prior to and during the descent of the hammer; and (c) a sear nested between the flange elements of the blocking piece which sear is rotated by rotating the blocking piece to release the hammer for its descent to strike the firing pin and fire the pistol.

6. The improvement of claim 5 in which the firing pin blocking piece and the sear are rotatable about the same axis.

* * * * *